United States Patent [19]

Boyer

[11] 4,415,092

[45] Nov. 15, 1983

[54] HOLDER FOR UNIFORMLY SHAPED ARTICLES

[76] Inventor: Thomas B. Boyer, 1926 Mullowney #49, Billings, Mont. 59102

[21] Appl. No.: 268,733

[22] Filed: Jun. 1, 1981

[51] Int. Cl.[3] ..... A47F 7/00

[52] U.S. Cl. ..... 211/60 R; 211/69.1; 220/20.5; 221/66

[58] Field of Search ..... 211/60 R, 69.5, 69.1, 211/69.8; 221/307, 66; 248/314; 312/43, 45, 72; 220/20.5

[56] References Cited

U.S. PATENT DOCUMENTS

| | | | |
|---|---|---|---|
| 516,967 | 3/1894 | Dudley | 221/185 |
| 1,190,128 | 8/1915 | Doyle | 221/66 |
| 1,468,726 | 9/1923 | McKim | 221/66 X |
| 1,631,091 | 5/1927 | Frick | 221/66 |
| 2,093,517 | 9/1937 | Gibson | 220/20.5 |
| 2,812,563 | 11/1957 | Barber | 211/69.8 X |
| 2,959,296 | 11/1960 | Case | 211/69.1 |
| 3,804,293 | 4/1974 | Redman | 221/66 X |
| 3,809,287 | 5/1974 | Muller-Scherak | 221/66 |
| 4,193,511 | 3/1980 | Taber | 221/66 |

FOREIGN PATENT DOCUMENTS

| | | | |
|---|---|---|---|
| 296835 | 9/1928 | United Kingdom | 312/49 |

*Primary Examiner*—James T. McCall
*Assistant Examiner*—David L. Talbott
*Attorney, Agent, or Firm*—Wells, St. John & Roberts

[57] ABSTRACT

An open-ended holder for releasably supporting a number of uniformly shaped elongated articles. The holder will release one article as another is pushed into its place. One article can be used to directly push another from its individual holding chamber within the holder and thereby displace it. The article used as the pusher then becomes supported within the holder and the article previously held within the chamber is discharged and is free for use. Individual chambers of the holder have provisions between opposed ends for releasably supporting the articles therein. Any one of the articles, once freed, can be used to push another longitudinally from a chamber, progressively replacing it within the same chamber.

8 Claims, 6 Drawing Figures

HOLDER FOR UNIFORMLY SHAPED ARTICLES

BACKGROUND OF THE INVENTION

The present invention relates to holders for uniformly shaped articles and more particularly to such holders that will release an individual article in response to reception of another in its place.

Holders, cartons or packs for supporting numbers of uniformly shaped articles typically include a single common access opening where one or more articles can be released simultaneously. This is, at times, too convenient since articles removed are often forgetten and not replaced. A specific example of this is the typical color crayon and the associated storage box. The common folding box top will open to allow the user immediate access to all the exposed crayons in the box. Therefore, several crayons can be removed, either one at a time, or simultaneously. Since only one crayon can be used effectively at a given time, the remaining crayon or crayons are often neglected and may not be returned to the box. Eventually, crayons litter the entire area.

This same problem is true also of other similarly shaped articles and their holders. Examples may be pencils, pens, firearm ammunition, hair curlers or rollers, etc. If the container is not used to keep the articles organized and safely stored, the container itself becomes part of the clutter.

Containers or holders for sequentially releasing individual articles, often from a nested stack therein, are well known. A good example of this type of holder is the paper cup dispenser, where the bottom cup of a stack projects beyond an open end of the dispenser. The bottom cup can be grasped and pulled away from the stack and holder. The cup is then discarded after use. If the cup is to be used again, it would have to be returned to the top of the stack within the holder.

A holder similar in function to the cup dispenser configuration is shown in U.S. Pat. No. 516,967 granted Mar. 20, 1894 to G. B. Dudley. Dudley shows a stack of shotgun cartridges within a holder having spring fingers at the bottom end for releasably supporting the stack. The bottom cartridge can be removed by pulling it downwardly from engagement with the spring fingers. Only the bottom cartridge of the stack is accessible with this arrangement, just as only the bottom cup of a cup dispenser is accessible.

U.S. Pat. No. 3,804,293 discloses a pencil box for storing a sharp pencil and for ejecting the sharp pencil in response to insertion of a dull pencil. The dull pencil and sharp pencils are held in adjacent chambers. A sliding plate projects across both chambers and is urged toward one end of the box. A dull pencil is used to push against the plate, moving it toward the opposite box end. The opposite side of the plate, in turn, pushes a sharp pencil from the box. There is no direct engagement between one pencil and the other, nor does the dull pencil displace the sharp pencil within the same chamber. Once the dull pencil has been inserted, special measures must be taken before it can be removed for resharpening.

The present invention is distinguishable over the above apparatus both physically and by nature of its function. The present holder is intended to hold a plurality of articles in individual storage chambers. Each article can be removed without affecting the others and is automatically replaced by the article that manually displaces it from the holder. In this way, only a single article is freed for use at any one time, since the previously used article must be restored to the holder before a different article is released. There is therefore less chance that the holder and articles will become separated and lost, or that the articles will be found cluttering an area with the holder itself adding to the clutter.

It is a primary object of the present invention to provide a holder wherein release of any one selected stored article can be effected by displacement thereof with a manually inserted similar article.

It is also an object to provide such a holder that can be easily adapted to releasably support a wide variety of uniformly shaped articles. For example, variations of the present holder can be made to releasably support groups of pencils, pens, markers, hair rollers, firearm cartridges, film packs, etc. The only requirement is that all articles of the group must be of uniform shape.

DETAILED DESCRIPTION

Figure 1:
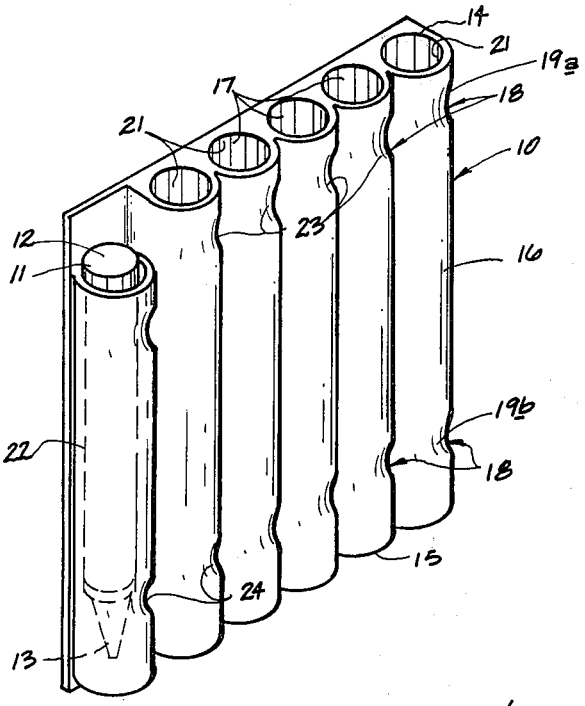
FIG. 1 is a pictorial view of one form of the present holder.
Figure 2:
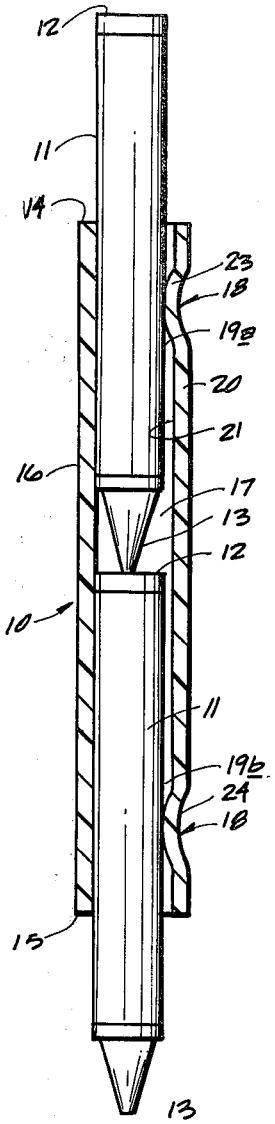
FIG. 2 is an enlarged longitudinal sectional view showing operation of the holder shown in FIG. 1.
Figure 3:
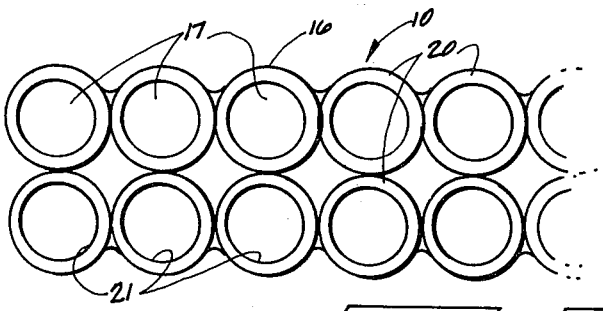
FIG. 3 is a fragmentary end view of a variation in the holder shown in FIGS. 1 and 2.
Figure 4:
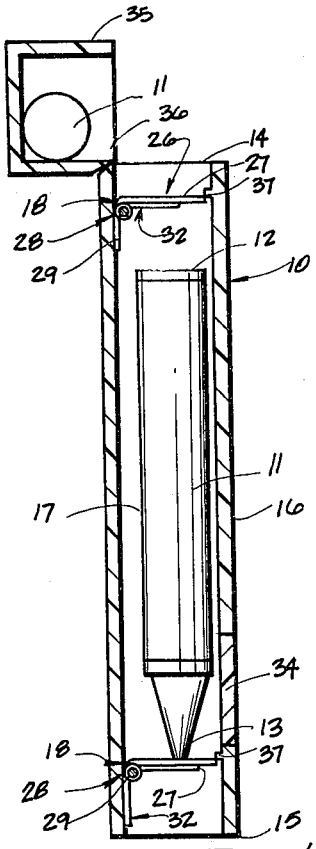
FIG. 4 is a longitudinal sectional view through another form of the present holder.
Figure 5:
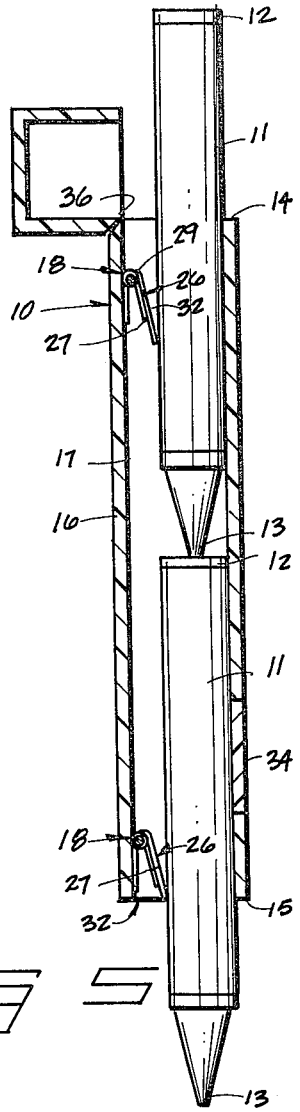
FIG. 5 is an enlarged view similar to FIG. 4, showing its operation.
Figure 6:
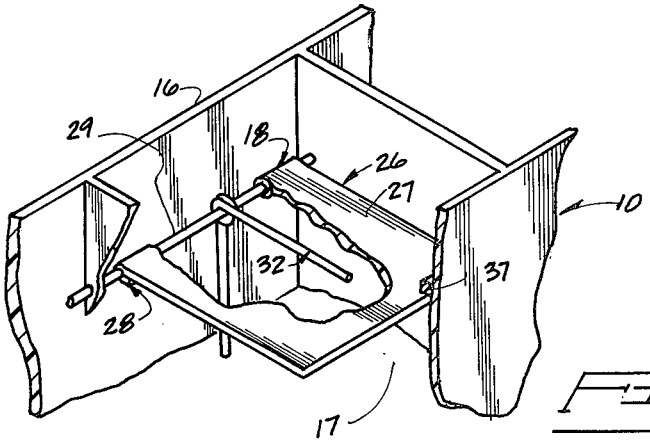
FIG. 6 is a fragmentary detailed view of a flap arrangement for the holder illustrated in FIGS. 4 and 5.

Two forms of the portable holder 10 are shown in the accompanying drawings. A first form is shown in FIGS. 1 through 3 and a second form is shown in FIGS. 4 through 6. The function of either holder shown is to releasably hold groups of similar articles 11 such as crayons, bullets, shotgun shells, pencils, pens, markers, pastels, hair rollers, etc. that have uniform shapes. In fact, it is preferred that such articles be elongated and substantially cylindrical as are the crayons shown in FIGS. 2, 4 and 5. For purposes of later description, each of the articles will be said to include a top end 12 and a bottom end 13.

Both forms of the holder 10 basically include elongated hollow housings 16. Each housing 16 includes an open top 14 and a longitudinally spaced open bottom end 15. Intermediate the ends 14 and 15 is at least one or more individual chambers 17.

Means 18 is provided along the housing inward of the opposed housing ends 14, 15 for supporting articles within the chambers. Means 18 yieldably resists longitudinal motion of an article 11 supported within the associated chamber in response to longitudinal force applied by another of the articles placed in end-to-end pushing engagement with it. This operational arrangement is shown in FIGS. 2 and 5.

The individual chambers include longitudinal length dimensions between ends of the housing. Means 18 may be situated at or adjacent to opposed ends 19*a*, 19*b* of the individual chambers. It is preferred that the longitudinal dimensions of the individual chambers be greater than the length of a single article, particularly with the holder form shown in FIGS. 4 through 6.

The holder 10 shown in FIGS. 1 through 3 may be constructed of integral plastic tubes 20. Such tubes 20 are particularly adapted to mass production since they may be extruded and formed of a common resilient plastic material such as polyvinyl.

The individual tubes 20 can be supplied in any of several configurations. FIG. 1 shows a single row of tubes 20 formed integrally with one another. FIG. 3 shows a similar arrangement making use of two rows of the tubes 20. Other configurations can also be quite readily adapted for use with the integral tubular arrangement.

The individual tubes 20 include substantially cylindrical interior walls 21. The cylindrical configuration is suited for similarly shaped cylindrical articles 11 such as crayons. However, the interior tube configuration could also be polygonal or another closed curve configuration complementary to the cross-sectional configuration of the articles to be stored within the tubes.

The tubes 20 illustrated in FIG. 1 include a shortened tubular section 22. This shortened tubular section provides an additional chamber 17 with a length between its ends 19*a*, 19*b* that is substantially equal to the effective length of one of the articles 11. The shortened chamber allows initial finger access to an article held within.

An article 11 held within the short tube section 22 can be partially pushed outwardly of the shortened section by inserting a finger in one end 19*a* or 19*b* to push the article a short distance out of the opposite chamber end. The article can then be grasped and pulled from the chamber. This article 11 can then be used for manually pushing a different selected article 11 from any one of the remaining housing chambers 17.

Means 18 (as provided in the form shown in FIGS. 1 through 3) is integral with the individual tubes 20. It is comprised of constrictions 23 adjacent the top housing end and second constrictions 24 near the bottom. It is noted that placement of the constrictions and their numbers may vary according to design requirements. The configurations of the constrictions are, however, fairly uniform.

Each constriction is simply an integral indentation formed in each of the tubes 20, causing the interior wall 21 to project into the chamber 17. The distance between the innermost part of the projection and opposite part of the wall 21 is less than the overall cross-sectional dimension of the article to be held. The projecting wall will therefore frictionally engage the article and radially expand as each article moves into and away from the housing.

It is important that the holder shown in FIGS. 1–3 be constructed of a substantially resilient material in order that the constrictions 24 function properly. They should deflect somewhat in response to engagement by an article, yet provide sufficient resistance to such lateral movement to releasably support the article longitudinally within the chamber until sufficient outside force is applied in a longitudinal direction by another article.

Operation of the holder version shown in FIGS. 1–3 is best understood with reference to FIG. 2.

First, the article 11 held in the shortened tube section 22 is removed by the process briefly described above. It is forced part way from the shortened section 22 by simply pressing one end of the article longitudinally with a finger or similar object so its opposite end will slide outwardly from the shortened tube end. Enough of the article will become exposed to be grasped and pulled from the shortened chamber. This article can then be used.

Next, the removed article can force any one of the remaining articles held in the holder outward of its associated chamber. This is done by engaging the bottom end 13 of the used article with the top end 12 of the stored article. Longitudinal force is then applied against the stored article to push it longitudinally outward from the chamber as shown in FIG. 2. Continued longitudinal motion results in discharge of the stored article and its complete passage from within the associated chamber 17. This process can be repeated with respect to any of the articles stored in the holder.

Finally, when all desired articles have been used, the last article used is manually inserted into the shortened tubular section 22.

It is noted that the form of the present invention shown in FIGS. 1 and 2 is preferably constructed of a flexible, resilient plastic material such as polyvinyl. It is also preferred that the material be transparent or translucent. In this way, the articles held within the individual chambers may be readily identified.

The holder form shown in FIGS. 4 through 6 functions in the same basic manner as described above. The exception is that the holder 10 may be formed of a more rigid material and means 18 is provided in such a manner that only unidirectional motion of the enclosed articles is permitted.

FIGS. 4 through 6 show pivoted spring gates 26 situated at opposite ends of the chambers 17. Each of the spring gates 26 is mounted to the housing 16 for yieldably permitting longitudinal motion of an article in one direction into the associated chamber, for supporting the article within the chamber, and for resisting motion of the article in a direction opposite the one direction.

The spring gates 26 may be constructed using rigid flaps 27 mounted to the housing for pivotal motion about the axis of hinge means 28. The axis is preferably perpendicular to the length dimension of the individual chambers. The flap configuration is preferably complementary to the interior cross-sectional configuration of the chambers.

The hinge means 28 can be provided in the form of a pin 29 extending through the housing along the hinge axis. One edge or end of the flap 27 can be folded over the pin, journalling the flap for pivotal motion about the hinge axis. Similar pins 29 can be provided at opposed ends of the chambers and extending through adjacent chambers to pivotably support all of the required flaps 27.

Pivotal motion of the flaps 27 is allowed by a biasing means 32. Biasing means 32 yieldably urges the flaps about the hinge axis to operative positions (FIG. 4) projecting across the chambers. The biasing means 32 also permits yieldable deflection of the flaps in one direction through a maximum arc of approximately 90° in response to longitudinal force applied against the flap by one of the articles 11. The biasing means may be provided in the form of a torsion spring 33 connected between the housing and each flap 27. The coils of springs 33 may be wound about the pin 29. Such a spring is shown in detail in FIG. 6 and in operation in FIG. 5.

The springs 32 themselves may hold the flaps in their normal operative positions (FIG. 4). If desired, an additional stop 37 can be provided as an integral part of housing to prevent pivotal motion of each flap upwardly beyond its horizontal position. The stops are shown in FIGS. 4 and 6.

FIGS. 4 and 5 show a closure 35 situated at the top end of the housing 16. The closure 35 may be formed integrally with the housing, including an integral hinge 36. As shown in FIG. 4 the closure 35 can also be used to contain an article 11 which can be used in a manner similar to the article held in the shortened tubular section 22 of the other form of my holder. The closure 35 otherwise will facilitate merchandising of the holder by limiting access to the adjacent flaps 27.

Operation of the FIG. 4 through 6 version of my holder is similar to operation of the FIG. 1 through 3 version with the exception that the action involved is more positive. The flaps 27 firmly engage and slide against surfaces of the articles moving through the holder. The edges of flaps 27 engage against the articles to permit one way motion of the article only. They will wedge against the article if the article is forced in an opposite longitudinal direction. Therefore, the action of replacing one article with another in this form of holder is a positive motion. There is substantially little chance that one article can be used to push another partially out of the container and then be pulled itself in an opposite direction, thereby freeing both articles from the holder. Instead, the article being pushed into the container to free another is gripped positively by the flap and must be pushed into the associated chamber and subsequently pushed through in the same direction by the released article before it can be freed from the chamber.

It is understood that the housing may be formed of rigid material and that such material may be transparent, translucent, or opaque. However, it is preferred that a transparent window 34 be provided for each of the chambers 17 to allow visual inspection of the chamber contents.

It is emphasized that the above description is merely exemplary of two basic forms of the present holder. Many configurations and modifications of the present holder are contemplated but, for the sake of brevity, are not described herein.

What is claimed is:

1. A magazine for storing a plurality of elongated uniformly shaped articles and for permitting selective removal of one of the articles when replaced by another article, comprising:

a portable magazine housing having a plurality of separate storage compartments in which compartment is adapted to store only one article at a time therein;

biasing means associated with each compartment for releasably engaging each article in its respective compartment to prevent removal of the article from the compartment by gravity;

each elongated compartment having a longitudinal entrance opening and a spaced longitudinal exit opening in which spaced distance between the openings is greater than the normal length of the article to prevent the direct manual removal of the article from the compartment but to permit an unstored elongated article to be longitudinally inserted into one of the entrance openings and to be manually pushed into the compartment engaging and progressively axially forcing the article stored in the compartment longitudinally out through the exit opening as the unstored elongated article is pushed through the entrance opening into the compartment displacing and replacing the previously stored article.

2. The article magazine as claimed by claim 1 wherein said housing is constructed of a resilient material and wherein said biasing means is comprised of at least one constriction formed integrally with the housing projecting inwardly into each compartment adapted to yieldably press against an article as the article is moved longitudinally into and out of said compartment.

3. The article magazine as claimed by claim 2 wherein two constrictions are provided, one at each end of each compartment.

4. The article magazine as claimed by claim 1 wherein said biasing means is comprised of:

one-way spring gate means in each compartment between ends thereof for yieldably permitting longitudinal motion, in one direction, of an article into said compartment, for supporting the article within the compartment, and for resisting motion of the article in a direction opposite said one direction.

5. The article magazine as claimed by claim 4 wherein the one-way spring gate means is comprised of:

a flap having a configuration complementary to the cross-sectional shape of the compartment;

hinge means mounting the flap to the housing within said compartment for pivotal motion therein through a maximum arc of 90° about an axis transverse to the length of the compartment; and biasing means between the flap and housing for yieldably urging the flap about the hinge axis to an operative position projecting across the compartment and for yieldably deflecting through said arc in response to longitudinal force applied against the flap in the one direction.

6. The article magazine as claimed by claim 1 wherein the housing includes a transparent area communicating with each of the compartments to permit visual inspection of an article within the compartment.

7. The article magazine as claimed by claim 1 wherein the housing is formed of a resilient plastic material.

8. The article magazine as claimed by claim 1 wherein the housing includes a shortened compartment and wherein the length of the shortened compartment between open ends is equal to or less than the length of one of the articles to enable the article in the shortened compartment to be directly manually removed and used as an unstored article to displace and replace an article in one of the other compartments.

* * * * *